United States Patent [19]

Fuchs et al.

[11] 4,218,265

[45] Aug. 19, 1980

[54] METHOD AND AN ARRANGEMENT FOR THE CLEANING OF A FILLER PIPE IN A PACKING MACHINE

[75] Inventors: Alfred Fuchs, Lund; Erik T. Andersson, Dalby, both of Sweden

[73] Assignee: Tetra Pak International AB, Lund, Sweden

[21] Appl. No.: 948,408

[22] Filed: Oct. 4, 1978

[30] Foreign Application Priority Data

Oct. 5, 1977 [SE] Sweden ..... 7711137

[51] Int. Cl.[2] ..... B08B 3/02

[52] U.S. Cl. ..... 134/18; 134/22 C; 134/34; 134/115 R; 134/170; 134/199; 141/90; 141/91; 53/167

[58] Field of Search ..... 134/18, 22 C, 34, 56 R, 134/115 R, 167 C, 168 C, 170, 171, 199; 141/90, 91; 53/167, 551

[56] References Cited

U.S. PATENT DOCUMENTS

| | | | |
|---|---|---|---|
| 3,334,639 | 8/1967 | Grant | 134/199 X |
| 3,513,024 | 5/1970 | Culliton | 141/91 X |
| 3,716,083 | 2/1973 | Tuma et al. | 141/90 |
| 3,912,535 | 10/1975 | Rauser | 134/22 C |
| 3,964,526 | 6/1976 | Sindermann | 141/90 X |

FOREIGN PATENT DOCUMENTS

| | | |
|---|---|---|
| 2136934 | 1/1973 | Fed. Rep. of Germany . |
| 2347451 | 4/1974 | Fed. Rep. of Germany . |
| 2552011 | 6/1977 | Fed. Rep. of Germany . |

*Primary Examiner*—Richard V. Fisher

*Attorney, Agent, or Firm*—Burns, Doane, Swecker & Mathis

[57] ABSTRACT

In packing machines of the kind which form a tube of packing material for subsequent conversion into separate, filled packages, a filler pipe for the contents is usually arranged inside the material tube. Especially when the packing machine works with foodstuff under sterile conditions, the filler pipe as well as other machine parts situated inside the tube have to be carefully cleaned before and after production. As the filler pipe normally is surrounded by the foodstuff in the tube, it will have to be cleaned on the outside as well as the inside, and to facilitate the cleaning it is suggested to use a cleaning container, which has a controllable outlet and surrounds the lower end of the filler pipe and makes cleaning by circulation of a cleaning liquid possible. To increase the cleaning effect the cleaning liquid is circulated through the filler pipe as well as through separate nozzles directed towards the outside of the filler pipe.

16 Claims, 2 Drawing Figures

METHOD AND AN ARRANGEMENT FOR THE CLEANING OF A FILLER PIPE IN A PACKING MACHINE

BACKGROUND AND SUMMARY OF THE PRESENT INVENTION

The present invention relates to an arrangement for the cleaning of a filler pipe in a packing machine of the type which forms a packing material tube around the filler pipe, which tube is then filled with contents and is divided up into filled and closed packages by means of sealing jaws arranged underneath the end of the filler pipe, whereby the arrangement comprises lines and a pump for the circulation of a cleaning liquid.

The invention also relates to a method for the cleaning of a filler pipe in a packing machine with use of the abovementioned arrangement.

In the foodstuff industry the demand is made more and more often that products should be packed with the help of sterile packing processes. This applies especially to the packing of those foodstuffs which are sensitive and which present an opportune growth medium for bacteria, such as in the case of miik and cream.

A number of methods and machines have been produced to meet these demands for sterile packing processes, and among the sterile packing machines which are utilized for the packing of milk and cream there is to be found a machine of the type which converts a web of packing material which has first been sterilized to a tube whilst it passes vertically downwards through the machine. The tube is formed around a delivery pipe for the contents extending vertically through the machine and is provided with a longitudinal seal, whereupon the tube, continuing its downwards movement through the machine, is filled with the contents. At some distance underneath the end of the filler pipe a clamping together of the tube then takes place in that the tube walls are pressed together and sealed to one another in transverse zones extending over the tube. After a possible shaping phase, the tube is cut at regular intervals in the sealing zones so that packing containers separated from one another are obtained.

In the above packing machine mention is thus already made of the delivery pipe for contents, the so-called filler pipe, located inside the tube formed of sterilized packing material. Inside the tube, there is moreover a float arranged around the lower end of the filler pipe and a transfer mechanism between the float and a control valve arranged in the filler pipe, which parts, like the lower end of the filler pipe, are in direct contact with the sterile contents. These parts, in other words, must be extremely carefully cleaned.

The cleaning of the lower end of the filler pipe and the float arranged thereon takes place at present by hand-washing, which means that this part of the filler pipe is detachable and is removed for separate washing and sterilization, whereupon it is assembled again in position when production of the packing container commences. A certain risk of re-infection exists, however, in the course of the assembly work, and it has therefore been proposed that the parts should be sterilized in situ, the sterilizing agent (usually steam) being made to flow through the packing material tube. After the assembly of the washed filler pipe, the packing material tube is advanced so that it fully covers the delivery pipe, whereupon the material tube is sealed off at its lower end and the sterilizing agent is made to circulate through the delivery pipe and the packing material tube. In this method there is a great risk, however, that the hot and strong cleaning agent may penetrate through the tube wall.

It is an object of the present invention to provide a method and an arrangement which ensure an effective cleaning of the parts of the packing machine which during production come into direct contact with the contents present in the packing material tube.

It is another object of the present invention to provide a method and an arrangement which allow effective cleaning and sterilization of the parts without requiring one to dismantle them.

These and other objects have been achieved in accordance with the invention in that an arrangement for the cleaning of a filler pipe in a packing machine of the type which forms a packing material tube around the filler pipe, which tube is then filled with contents and is divided up into filled and closed packages by means of sealing jaws arranged underneath the end of the filler pipe, whereby the arrangement comprises lines and a pump for the circulation of a cleaning liquid, has been given the characteristic that the arrangement includes a cleaning container in the form of a tubular body which is surrounding the lower end of the filler pipe and has an inside diameter which is greater than the outside diameter of the packing material tube and a base which is provided with a controllable outlet line and connectable to the lower end of the tubular body in order to form, together with the tubular body, a space which surrounds the lower part of the filler pipe.

A preferred embodiment of the arrangement in accordance with the invention moreover has been given the characteristic that the tubular body is movable in relation to the filler tube and the packing material tube.

Another preferred embodiment of the arrangement in accordance with the invention moreover has been given the characteristic that the tubular body is arranged concentrically around the filler pipe and is displaceable between a lower, active position, where together with the detachable base it surrounds the lower end of the filler pipe, and an upper production position, where the packing material tube can pass without hindrance through the body.

Another preferred embodiment of the arrangement in accordance with the invention moreover has been given the characteristic that the tubular body is provided with a number of spraying nozzles pointed in the direction of the filler pipe of the packing machine which are connected via a delivery line to a pump.

The tubular part of the cleaning container is thus permanently placed in the machine, which makes possible a rapid and simple cleaning and sterilization. To ensure that it presents no hindrance during production, it can be moved to an upper position where its lower end does not interfere with the forming jaws of the machine and other elements acting upon the packing material tube.

A preferred embodiment of a method for the cleaning of a filler pipe in a packing machine with use of the abovementioned arrangement has been given the characteristic that cleaning liquid is delivered via the interior of the filler pipe as well as via nozzles in a cleaning container arranged around the lower end of the filler pipe and provided with a controllable outlet, the cleaning liquid being sprayed continuously via the nozzles in the direction of the filler pipe whilst the delivery of cleaning liquid through the filler pipe is instantaneously reduced when the level in the cleaning container exceeds a predetermined limit.

By means of the preferred method in accordance with the invention the inside of the filler pipe will be cleaned with the help of the cleaning liquid flowing through the filler pipe whilst the outside of the filler pipe as well as the float that may be arranged around the filler pipe will be cleaned partly by dipping into the cleaning liquid, partly by being directly sprayed with cleaning liquid.

In a further embodiment the method of the invention for the type of packing machines where the level of contents in the packing material tube is controlled by a valve which is actuated by a float located in the tube has been given the further characteristic that the said valve controls the delivery of cleaning liquid through the filler pipe in such a manner that during the cleaning procedure the float is displaced continuously between an upper and a lower limit position.

This means that when the outlet from the cleaning container is suitably adjusted the liquid level in the cleaning tank will successively increase and diminish, the float being displaced between its limit positions so that even the part of the filler pipe which is normally covered by the float will be exposed to liquid spraying.

In a further embodiment the method in accordance with the invention is characterized in that during the cleaning procedure the outlet is alternatingly opened and closed so as to achieve the desired level variations in the cleaning container. This makes for a more rapid level variation in the cleaning container and thus for a more effective cleaning.

BRIEF DESCRIPTION OF THE DRAWINGS

A preferred embodiment of the method and of the arrangement in accordance with the invention will now be described in detail with special reference to the enclosed schematic drawings which show only the parts necessary for the understanding of the invention wherein like members bear like reference numbers and wherein.

DETAILED DESCRIPTION OF THE PREFERRED EMBODIMENT

Figure 1:
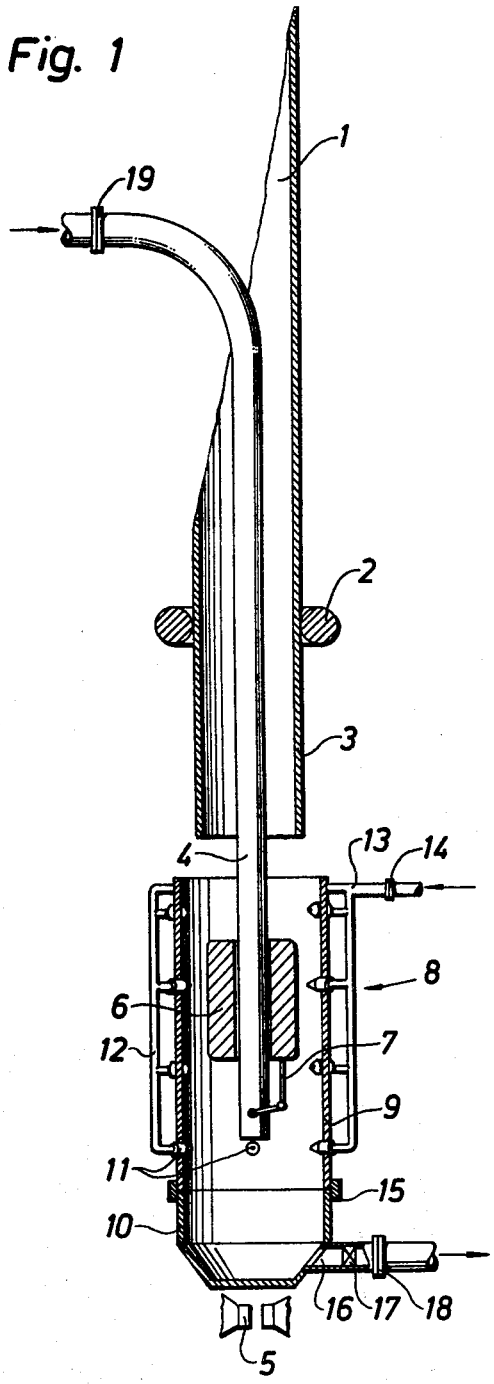
FIG. 1 is a cross sectional view of an arrangement in accordance with the invention during cleaning and sterilization; and, FIG. 2 is a cross sectional view of the arrangement in accordance with the invention in inactive position during the production of packing containers.

In the figures is shown a packing material web 1 which during the downward movement through a packing machine of known type, not shown, is successively converted with the help of a forming element 2 to a packing material tube 3. Inside the tube is shown a filler pipe 4 which extends through the upper, open end of the tube and then downwards through the packing material tube to end at some distance above the sealing jaws 5 of the packing machine. At the lower end of the filler pipe 4 a float 6, movable in vertical direction, is present which is situated outside the filler pipe and is connected by a linkage 7 with a control valve (not shown) arranged in the lower end of the filler pipe.

The arrangement in accordance with the invention comprises a cleaning container 8 which consists of two main parts, namely an upper tubular body 9 which is arranged concentrically around the filler pipe and a detachable base 10. In the upper, tubular body 9 a number of spray nozzles 11, e.g. twelve, are provided, which are distributed in circumferential as well as in vertical direction and which are pointed in the direction of the centre axis of the tubular body 9. All the nozzles 11 are connected via a number of distributing pipes 12 to a feed line 13 which can be connected via a coupling 14 to the outlet line of a cleaning pump, not shown in the drawing.

At the lower end of the tubular body 9 a coupling arrangement 15 is present, by which the tubular body can be connected with the base part 10. The base part 10 has an outlet line 16 which is provided with a valve 17 and a coupling arrangment 18 and which can be connected to the said feed line of the cleaning pump.

Figure 2:
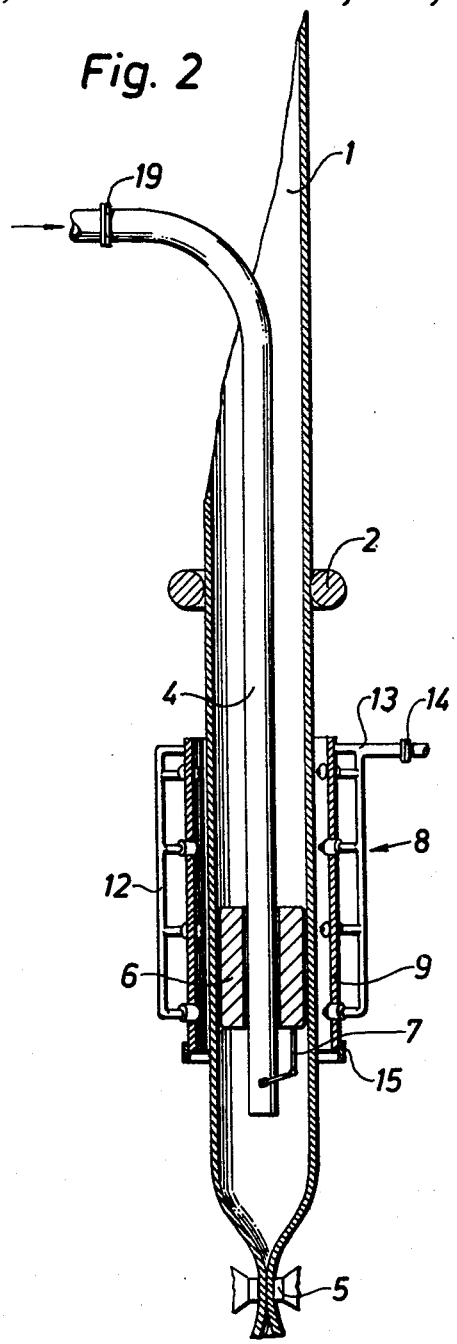

In FIG. 2 the cleaning container 8 is shown in its upper, inactive position which it assumes when the packing machine produces packing containers. The base 10 has been taken off and removed whilst the tubular body 9 has been shifted along guides or the like to its upper position where it is out of the way of the movable sealing and forming jaws of the packing machine.

The method in accordance with the invention will now be described in greater detail. When a packing machine of the type described is to be cleaned, the packing material tube 3 formed is cut off at some distance below the forming element 2, as shown in FIG. 1. The tubular body 9 of the cleaning container 8 is shifted to its lower position (FIG. 1) and the base part 10 of the cleaning arrangement is pushed in between the lower end of the filler pipe 4 and the sealing jaws and is connected to the lower end of the tubular body with the help of the coupling arrangment 15. Subsequently, the outlet line 16 of the base is connected with the help of the coupling device 18 to the inlet valve in the aforementioned pump for cleaning liquid which is of a known type and comprises a storage tank for cleaning liquid, inlet and outlet lines and an electrically driven circulation pump.

The line 13 for the delivery of cleaning liquid to the nozzles 11 is connected via the coupling device 14 to the delivery line of the cleaning pump which is likewise connected to the coupling device 19 at the upper end of the filler pipe 4. The connection of the filler pipe to the product line is interrupted at the same time.

When the control valve 17 present in the outlet line 16 has been set to a value found by experience to be appropriate, the cleaning pump is set in motion and washing liquid which e.g. may consist of 2% caustic soda flows to the cleaning container 8 via the filler pipe 4 as well as the nozzles 11. From the nozzles 11 liquid flows under strong pressure in the direction of the outside of the lower end of the filler pipe 4 and the float 6 with linkage 7 located there. With the help of the control valve 17 the outlet line 16 has been throttled to such an extent that on continued pumping of cleaning liquid to the cleaning container 8 the cleaning liquid level will rise successively until the float 16 is lifted and via the linkage 7 throttles the valve present in the filler pipe 4 so that the feed of cleaning liquid via the filler pipe 4 is reduced or completely stopped. When cleaning liquid is delivered only via the nozzles 11, the amount of liquid which per unit of time passes through the outlet duct 16 and the control valve 17 will be greater than the cleaning liquid which is delivered at the same time, so that the level in the cleaning container 8 drops until the float 6 opens the valve, so that cleaning liquid is delivered once more via the filler pipe 4. This process will be repeated during the entire cleaning or washing procedure and continuous adjustments of the valve in the outlet line 16 may be necessary. In case of heavy contamination the cleaning effect can be intensified further by alternatingly fully opening and closing the valve which produces a more intensive washing process with more rapid level changes in the cleaning container. Owing to the float 6 being displaced the whole time between its topmost and lowest position, all parts of the float 6 as well as the linkage 7 and back parts of the outside of the filler pipe 4 will be subjected to cleaning liquid, since the latter on the one hand reaches the said elements in the form of a concentrated jet from the nozzles 11 and on the other hand washes around the elements when the level in the cleaning container 8 has risen to a sufficiently high degree. In the same manner not readily accessible portions, e.g. the space between flat and filler pipe, are effectively cleaned.

When the washing process has gone on for the required time, e.g. for two or three periods of 5 minutes each, and possibly different types of washing solution and cleaning liquid have been used, the delivery lines are closed and the cleaning container is emptied. Then the valve 17 is closed and the packing material tube 3 is moved down through the tubular body 9 until its lower end comes to rest against the base part 10, whereupon the inside and outside of the delivery pipe as well as the inside of the packing material tube are sterilized in that any suitable sterilizing agent, e.g. overheated steam is introduced into the packing material tube via the filler pipe 4 and is allowed to escape through the upper open end of the packing material tube. When the sterilization is finished after a certain time (approx. 5 minutes) the production of packing containers can start. To this end firstly the coupling between the tubular cleaning container part 9 and the base part 10 is released and the base part is dismantled and removed. Then the tubular body 9 is raised to the position shown in FIG. 2 and the packing material tube is drawn down through the body 9, so that the lower end of the tube can be sealed with the help of the sealing jaws 5. Then the filler pipe 4 is connected to the delivery line for the contents and the machine is started.

In accordance with another, in some cases preferred procedure the level variations in the cleaning container are controlled by alternatingly opening and closing the valve 17, which may be done manually or e.g. by means of a time-controlled motorized unit. The valve may be maneuvered moreover in parallel with a liquid flow through the valve controlling the filler pipe which throttles the feed as the outlet is opened. In this way a more rapid level variation and hence more effective cleaning is achieved.

Although the method and the arrangement in accordance with the invention have been described in connection with a special type of machine for the manufacture of sterile packing containers, it can of course also be applied to other non-sterile machines.

The method in accordance with the invention ensures an effective cleaning and sterilization of all the parts which during the production of packing containers are in direct contact with the contents. As no dismantling or manual washing of the filler pipe or float are necessary, any risk of reinfection during assembly is eliminated. The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the present invention.

What is claimed is:

1. An arrangement for cleaning a filler pipe of a packing machine, especially for machines which form a packing material tube around the filler pipe, the tube then being filled with contents and divided up into filled and closed packages by sealing jaws arranged beneath an end of the filler pipe, comprising:

cleaning container means for selectively containing a cleaning liquid, the container means including a first member separate from the packing material tube which first member surrounds the lower end of the filler pipe and a second member which is selectively connectible to the first member to form a container;

means for selectively supplying the cleaning liquid to the container; and means for withdrawing the cleaning liquid from the container.

2. The arrangement of claim 1 wherein the first member is tubular and has an inside diameter which is greater than an outside diameter of the packing material tube.

3. The arrangement of claim 1 wherein the means for selectively withdrawing the cleaning liquid includes a valved outlet line.

4. The arrangement of claim 1 wherein the means for selectively supplying the cleaning liquid to the container includes a supply line and a pump.

5. The arrangement of claim 4 wherein the means for supplying the cleaning liquid further includes a plurality of spray nozzles oriented towards the filler pipe, each of the spray nozzles communicating with the supply line.

6. The arrangement of claim 1 wherein the first member is movable between first and second positions relative to the filler tube and the packing material tube.

7. The arrangement of claim 6 wherein the first member is concentrically arranged about the filler tube and moves axially relative to the filler tube and the packing material tube between the first and second positions.

8. The arrangement of claim 7 wherein the entire first member is vertically above a lowermost end of the filler tube in the first position and wherein a lowermost end of the first member is vertically below the lowermost end of the filler tube in the second position whereby the second member may be connected to the first member in the second position.

9. A method of cleaning a filler pipe of a packing machine, especially of a machine which forms a packing material tube around the filler pipe, the tube then being filled with contents and divided up into filled and closed packages by sealing jaws arranged beneath an end of the filler pipe, comprising the steps of:

providing a first member of a cleaning container separate from the packing material tube around a lower end of the filler pipe;

connecting a second member of the cleaning container to a lower end of the first member to form the cleaning container;

selectively supplying cleaning liquid to the container; and withdrawing the cleaning liquid from the container.

10. The method of claim 9 wherein the first member is provided to surround the packing material tube.

11. The method of claim 9 further comprising the steps of:

removing the second member from the first member; and, moving the first member axially with respect to the filler tube.

12. The method of claim 11 wherein the first member is moved until a lowermost end of the first member is vertically above a lowermost end of the filler tube.

13. The method of claim 11 further comprising the step of:

spraying the filler pipe and packing material tube with the cleaning liquid through a plurality of spray nozzles.

14. The method of claim 11 further comprising the step of:

interrupting the supply of the cleaning liquid to the container when a level of cleaning liquid in the container exceeds a predetermined level.

15. The method of claim 11 wherein a float of the machine is moved axially with respect to the filler tube during said cleaning.

16. The method of claim 15 wherein the float is moved axially by varying the level of the cleaning fluid in the container.

* * * * *